United States Patent [19]

Miller

[11] 4,100,953

[45] * Jul. 18, 1978

[54] FLEXIBLE COLLAPSIBLE CONTAINER DEFINING RELATIVELY RIGID SHOULDER AND BASE AT OPPOSITE ENDS

[75] Inventor: Joe A. Miller, Lake Zurich, Ill.

[73] Assignee: Baxter Travenol Laboratories, Inc., Deerfield, Ill.

[ * ] Notice: The portion of the term of this patent subsequent to May 9, 1995, has been disclaimed.

[21] Appl. No.: 751,613

[22] Filed: Dec. 16, 1976

Related U.S. Application Data

[60] Continuation-in-part of Ser. No. 526,093, Nov. 21, 1974, abandoned, and Ser. No. 669,058, Mar. 22, 1976, which is a division of Ser. No. 526,093.

[51] Int. Cl.[2] ..... B65D 1/02

[52] U.S. Cl. ..... 150/0.5; 222/107

[58] Field of Search ..... 150/0.5, 1; 222/107

[56] References Cited

U.S. PATENT DOCUMENTS

| | | | |
|---|---|---|---|
| 3,081,002 | 3/1963 | Tauschinski | 222/107 X |
| 3,215,299 | 11/1965 | Coanda | 215/100 A |
| 3,406,873 | 10/1968 | Zackheim | 222/107 |
| 3,595,441 | 7/1971 | Grosjean | 150/0.5 |
| 3,810,503 | 5/1974 | Lewis | 150/1 X |

*Primary Examiner*—Donald F. Norton

*Attorney, Agent, or Firm*—Paul C. Flattery; John P. Kirby, Jr.; Gary W. McFarron

[57] ABSTRACT

A flexible, collapsible container defining a relatively rigid shoulder and neck portion at one end and a relatively rigid base at the other end, and having a flexible tubular wall between the shoulder and the base, utilizes first and second pairs of oppositely-disposed gusset portions defined in the flexible walls and positioned respectively adjacent the shoulder and the base. The gussets are adapted to fold outwardly from the shoulder and base as the container collapses.

10 Claims, 7 Drawing Figures

FIG. 1
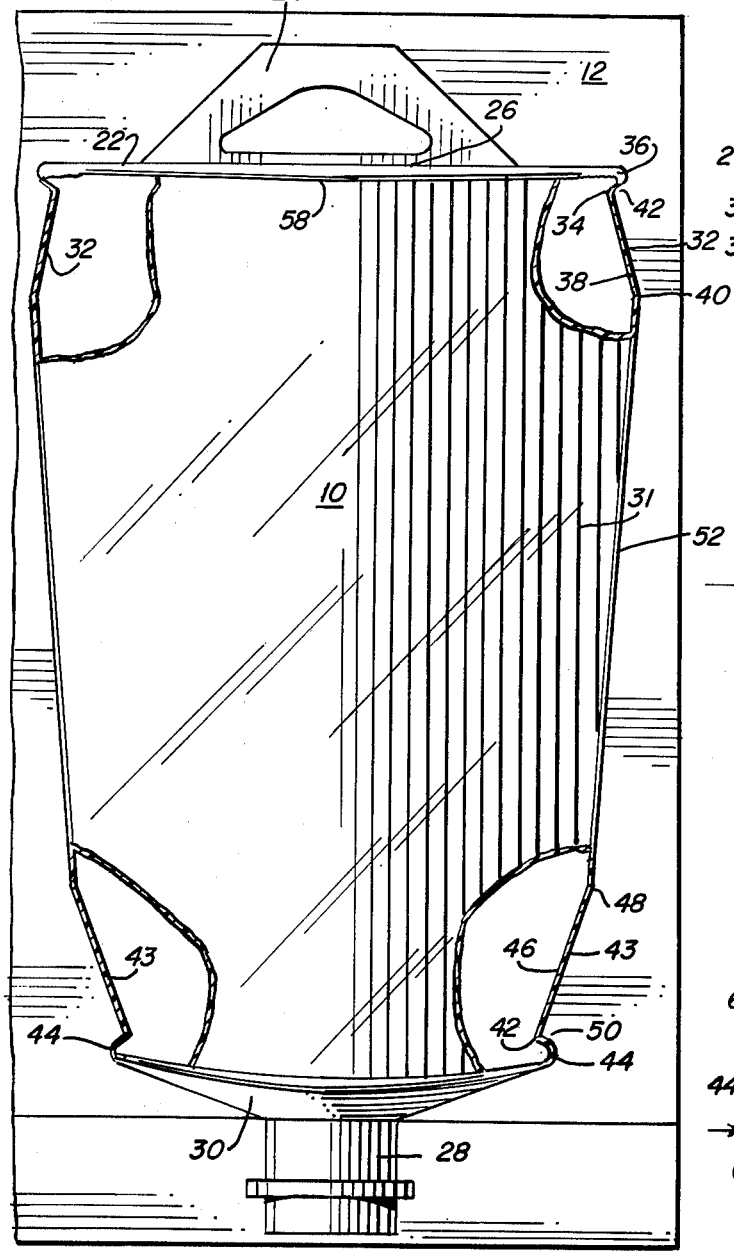
FIG. 3
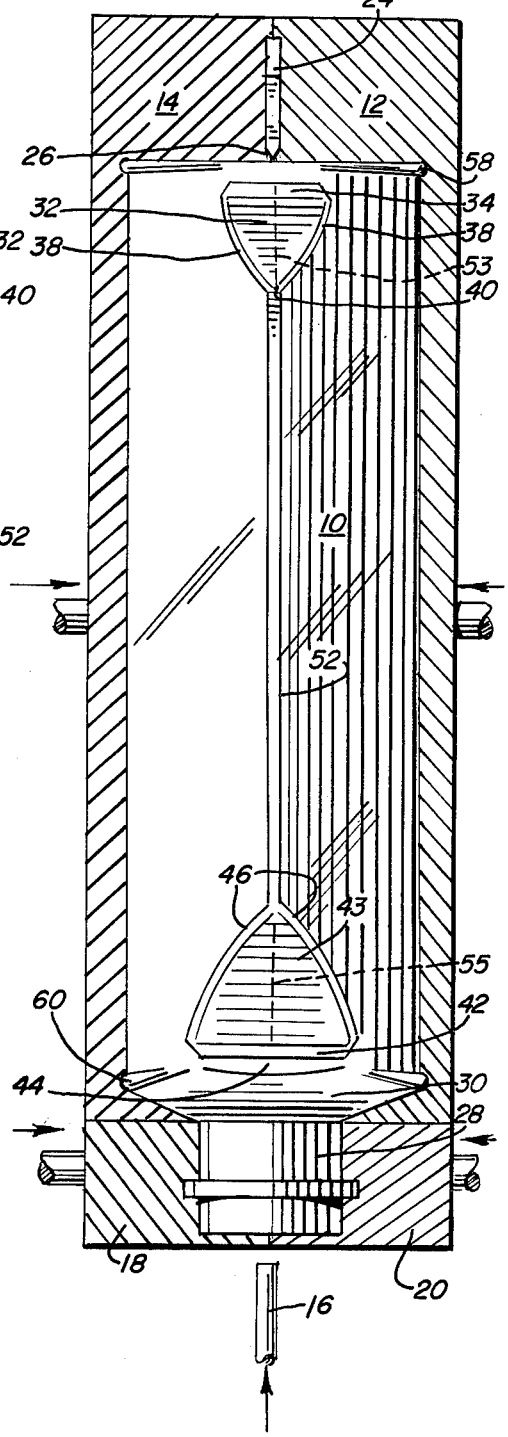
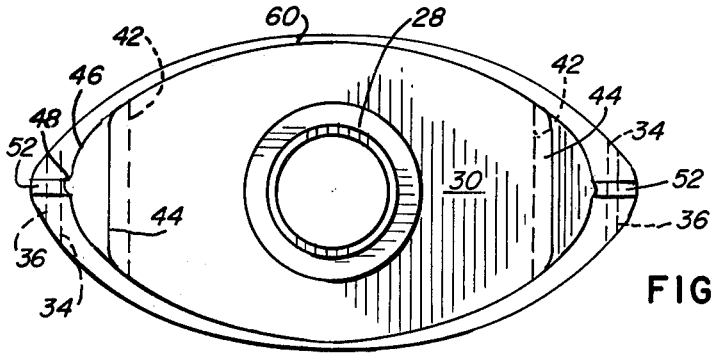
FIG. 2

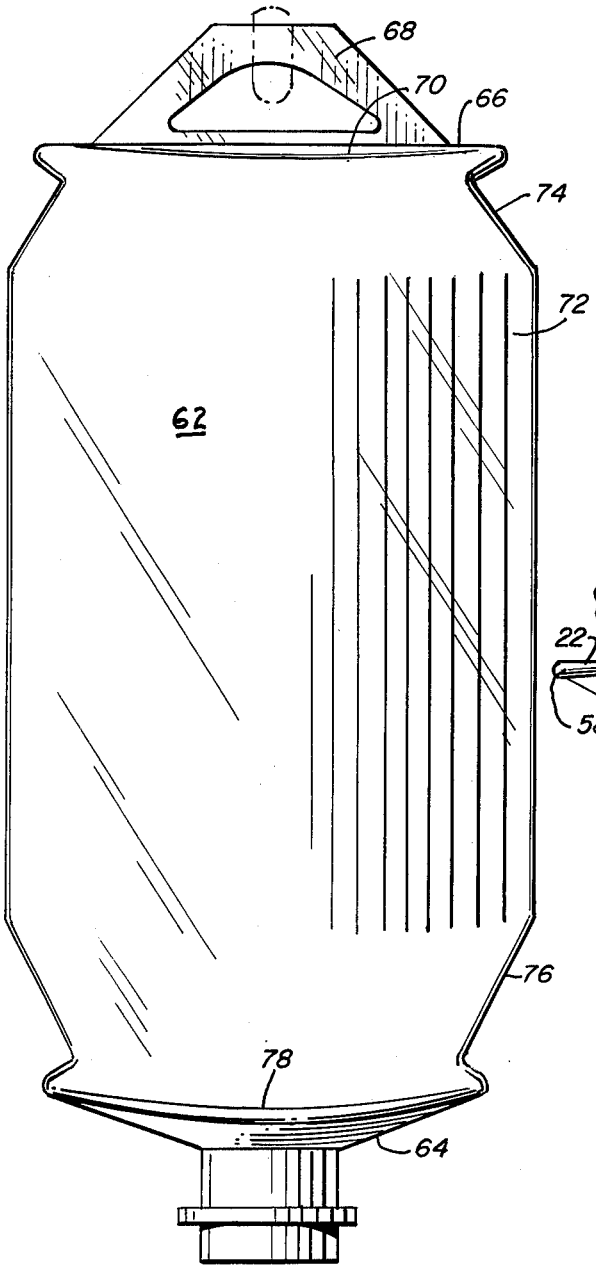
FIG. 7
FIG. 4
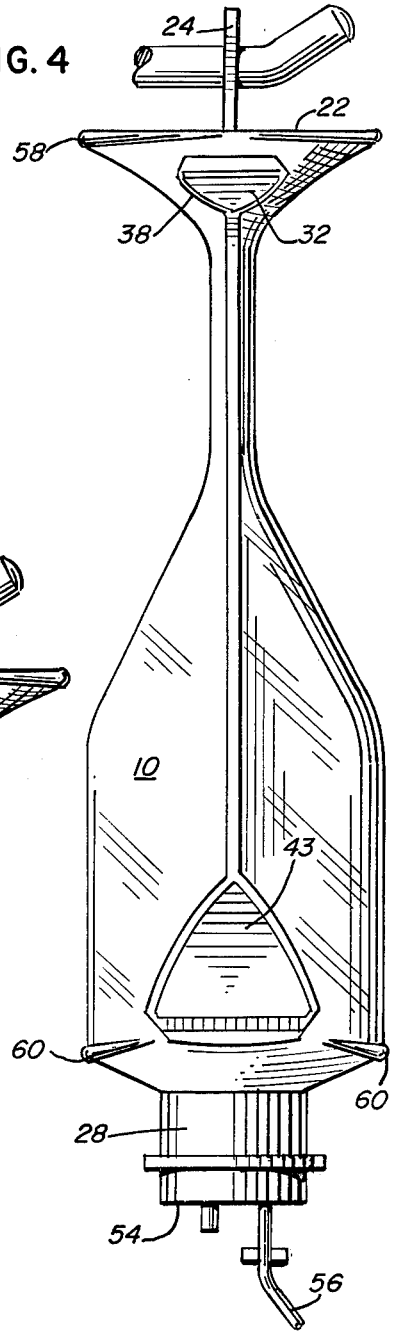
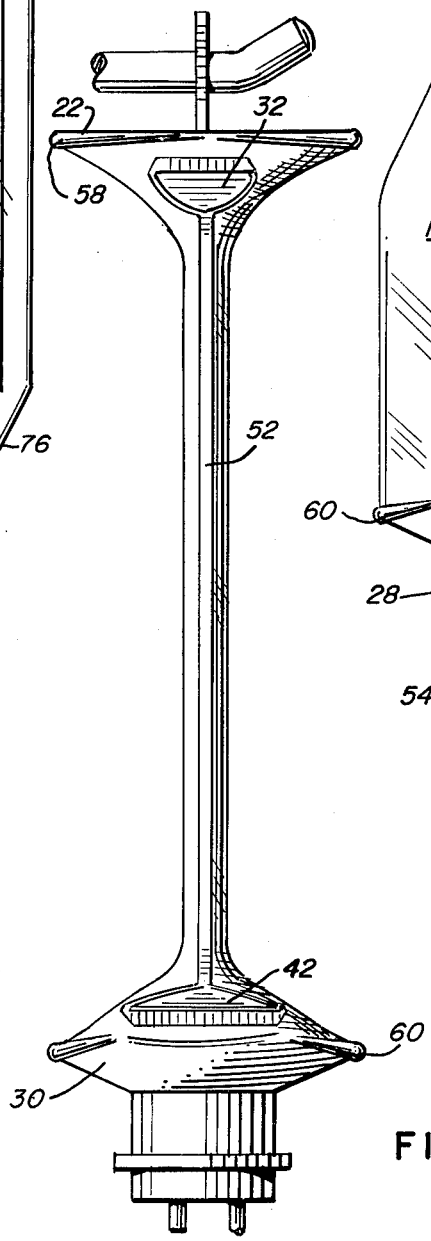
FIG. 5

FLEXIBLE COLLAPSIBLE CONTAINER DEFINING RELATIVELY RIGID SHOULDER AND BASE AT OPPOSITE ENDS

CROSS-REFERENCE TO RELATED APPLICATION

This application is a continuation-in-part of abandoned U.S. application Ser. No. 526,093, filed Nov. 21, 1974, by Joe A. Miller, and U.S. application Ser. No. 669,058 filed Mar. 22, 1976 which, in turn, is a division of the previously-cited application.

BACKGROUND OF THE INVENTION

Containers which are made of flexible material, so that they can easily collapse upon draining to a residual volume which is a very small percentage of the original filled volume, find particular use in the area of parenteral solution administration. Also, these containers can be put to any other use, particularly those uses where the venting of air into the container as it is emptied is considered not to be desirable.

In Grosjean U.S. Pat. No. 3,595,441, a collapsible tubular container of square cross section is disclosed utilizing a relatively rigid shoulder at one end, and a base at the other, about which the remainder of the container collapses through the infolding of gussets similar to those found in a paper bag.

The container of the Grosjean patent shares the characteristic with many other collapsible containers in that it is difficult to ascertain how much solution has been administered from the container, which is of course important to know in the field of administration of parenteral solutions. Furthermore, the Grosjean container is very complex and is subject to malfunction, since each gusset includes seven individual fold lines which must all function as intended in order to obtain the desired folding results. Added to the total of twenty-eight fold lines in the four gussets are three fold lines on each of the sides of the container, to permit the achievement of the inward folding structure, in the manner of a paper bag having double, opposed bottom ends, as shown in the drawings of the Grosjean patent.

It is sometimes deemed desirable to have a flexible, collapsible container which, nevertheless, can stand up on a relatively rigid base while it is full. Furthermore, it is desirable to provide a structure having fewer fold lines, so that there is less chance that a failing fold line will interfere with the collapse of the container.

DESCRIPTION OF THE INVENTION

In accordance with this invention, a flexible, collapsible container defines a relatively rigid shoulder and neck portion at one end, and a relatively rigid base at the other end. A flexible, tubular wall is positioned between the shoulder and the base.

First and second pairs of oppositely-disposed gusset portions are defined in the flexible walls and positioned, respectively, adjacent the shoulder and the base. The first pair of gussets each define in the wall a recessed, folded line, positioned adjacent to and in generally longitudinal relation to the adjacent edge of said shoulder. The second pair of gussets also each define a recessed, folded line positioned adjacent to and in generally longitudinal relation to the adjacent edge of said base.

Each gusset portion also defines in the wall a pair of lines of folding weakness which join together in angular relationship to define an outwardly-pointing apex 40 with respect to the longitudinal axis of the container, each apex 40 also pointing away from base 22. The lines of folding weakness extend toward the respective ends of their associated, recessed folded lines to define a generally triangular arrangement.

Upon collapse of the container, the gussets fold outwardly respectively from the shoulder and base, while portions of the container positioned between the gussets tend to simultaneously fold inwardly.

This simpler folding arrangement provides for three fold lines per gusset and only one fold line on each longitudinal edge of the container. Furthermore, the outward folding of the gussets prevents the entrapment of the last amounts of the container's contents as it collapses.

The gussets which are adjacent the base of the container of this invention may optionally be smaller or at least of less triangular elevation than the gussets adjacent the shoulder portion. Accordingly, the collapse of the container, as the contents are withdrawn, takes place first directly adjacent to the base, and thereafter progressively from the area of the base towards the shoulder, culminating in the outward collapse of the gussets next to the shoulder and inward collapse of the remaining portions of the container. The container folds up about the inner surfaces of the shoulder and base to create a very small residual volume when based upon the original volume of the container.

Because of the progressive tail-to-head collapse of the container when held in inverted position, it becomes feasible to make a reasonably accurate determination of the amount of contents of the container which have been expended, which is particularly important when the container is a parenteral solution administration container or other medical liquid container. However, simultaneously with this, the container of this invention is capable of standing on its base while full, and also collapsing down to a residual volume which may be about five percent of its original volume.

Preferably, the shoulder and base of the container of this invention are generally oval in shape, but preferably with truncated ends, the gussets being positioned adjacent the ends of the major axes of the shoulder and base.

It is also contemplated that, optionally, the circumference of the tubular wall between the shoulder and base may increase in the direction of said base so that the container exhibits a tapered or frustroconical aspect.

Referring to the drawings, FIG. 1 is an elevational view, with parts broken away, of the container of this invention, shown lying in a mold half used for manufacture of the container by blow molding.

FIG. 2 is a plan view of the container of this invention from the shoulder end.

FIG. 3 is an elevational view of the container of this invention, rotated 90° about its longitudinal axis from the aspect shown in FIG. 1, also showing the molds used to manufacture the container.

FIG. 4 is an elevational view of the container of FIGS. 1 through 3 in the condition of having its contents partially withdrawn, and the wall portion adjacent to the base being folded up.

FIG. 5 is an elevational view similar to FIG. 4, showing the essentially completely collapsed container after virtually all of the contents have been expelled.

FIG. 7 is an elevational view of an alternative embodiment of the container of this invention.

Figure 6:
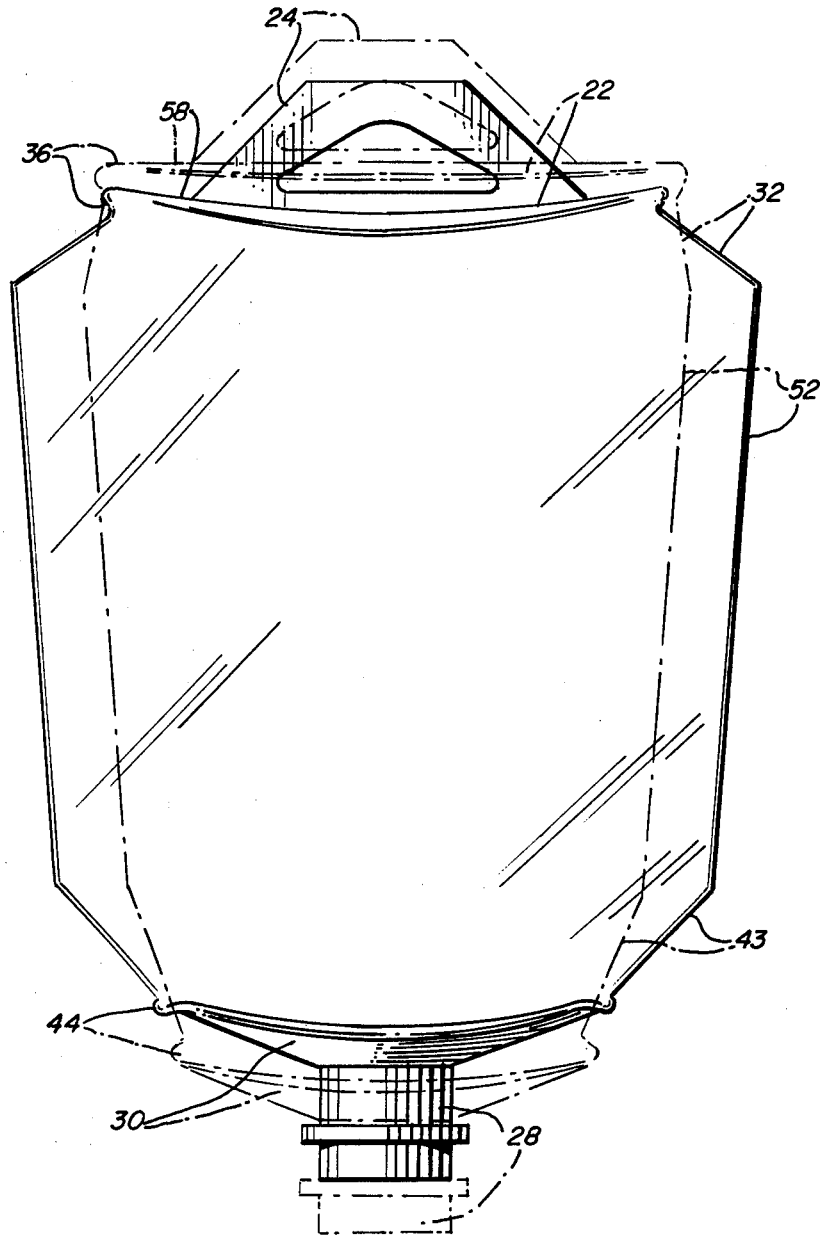
FIG. 6 is an elevational view similar to FIG. 5, rotated 90° about the longitudinal axis, also showing the filled configuration of the container in phantom lines for comparison.

Referring to FIGS. 1 through 3, container 10 is shown positioned in a blow mold half 12. As shown in FIG. 3, mating mold half 14 is provided to enclose a parison which may then be blow molded to form container 10, using retractable blowing tube 16 (shown in the retracted position). Neck mold halves 18, 20, which may be separate, are also shown. All of the mold halves are mounted on pistons for advancement and retraction as desired to receive the hot parison, to close around it, and to expel the completed, blow-molded container 10 in accordance with conventional technology.

Container 10 defines a generally flat, relatively rigid base 22 from which protrudes a hanger member 24. Hanger member 24 may be connected to base 22 by a thinned web portion 26 so that hanger member 24 can be easily folded into flat, parallel relation with base 22 when it is desired to stand the container up. Hanger member 24 may be integral with container 10, or may be separately added after manufacture.

At the other end of the container is defined a relatively rigid neck portion 28, through which the contents of the container may be inserted and withdrawn, and a relatively rigid shoulder portion 30.

Tubular wall 31, which is relatively flexible when compared with the relatively rigid base 22 and shoulder portion 30, extends between the peripheries of shoulder portion 30 and base 22 to form a sealed, flexible container.

The container of this invention is advantageously made from materials having a plastic flexural modulus of at least 60,000 according to the test of ASTM-D790 (secant modulus of elasticity), and preferably no more than about 250,000 for example medium and high density polyethylene, polypropylene, or copolymers thereof.

In accordance with this invention, opposed pairs of gusset portions are provided in tubular wall 31 adjacent both base 22 and shoulder 30. Gussets 32, adjacent base 22, are defined during the blow molding operation by appropriate channels and elevations defined in mold halves 12, 14. Included in each gusset 32 is a recessed, folded line 34 positioned adjacent to and in generally longitudinal relation to the adjacent truncated edge 36 of the generally oval base.

Each gusset portion 32 also defines in the wall 31 a pair of lines of folding weakness 38 which join together in angular relationship to define an outwardly pointing apex 40, which also points away from base 22. The lines of weakness 38 extend toward respective ends of their associated recessed, folded line 34 to define a generally triangular arrangement.

Recessed line 34 may be formed by a projection 42 in each mold half 12, 14 (FIG. 1). Portion 36 of base 22, as well as lines of weakness 38, may be defined by mold halves 12, 14, using grooves defined in the mold halves, as particularly shown with respect to edge portion 36 in FIG. 1. These groove portions may preferably define, in cross section, arcs in the mold halves having a circumferential length which is from forty to sixty percent greater than the direct width of such grooves. The result of this is that, as the plastic material of the container expands into the grooves in the mold, a thinning effect takes place so that the minimum wall thickness within the lines of folding weakness is preferably from about forty to seventy percent of the thickness of the container wall adjacent the lines of folding weakness. Accordingly, the folding characteristic of the container is focused, and the lines of folding weakness provide improved ease of folding when subjected to a low suction pressure, as may be encountered when the contents of the container are expelled through a parenteral solution administration set.

The gussets 43 adjacent shoulder 30 also define a recessed, folded line 42 which is in generally longitudinal relation with the adjacent edge 44 of shoulder 30.

Lines of folding weakness 46 are defined in each gusset 43, and join together in angular relationship to define an outwardly pointing apex 48, which also points away from shoulder 30. The lines of weakness 46 extend toward respective ends of their associated, recessed folded line 42 to also define a generally triangular arrangement.

Recessed, folded line 42 may be formed by a projection 50 in mold halves 12, 14, as shown in FIG. 1, while truncated edge 44 of generally oval shoulder 30 may be formed by a groove in the mold halves as shown, with the result that the shoulder tips 44 are thinned in the manner of oval base edges 36 and form a line of flexing weakness. Lines of weakness 46 may also be formed by grooves in the mold halves, and thus thin as they expand into the grooves, forming the lines of flexing weakness.

If desired, longitudinal line of folding weakness 52 may also be formed in container 10, if desired, by a longitudinally positioned groove in the mold, into which the parison can expand and accordingly thin, as previously described for other lines of folding weakness.

As shown in FIG. 3, gussets 32 define a roughly triangular shape with a pair of curved legs 38, the elevation 53 of the triangular gusset 32 being less than the elevation 55 of gusset 43, for example from three fourths to one half the length of elevation 55. Similarly, the length of line 34 may be less, for example, from three fourths to one half of the corresponding length of line 42. Alternatively however, it is also contemplated that the various gussets may be of equal size, or that gussets 32 may even be larger than gussets 42. The relative sizes and dimensions of base 22 and shoulder 39 may also be varied as desired.

Referring to FIG. 4, it is shown how the container of this invention can preferably collapse at its upper end in its position of use, which end is base 22. Container 10 is shown to be hanging from its hanger 24, with a conventional closure 54 having been attached by heat or solvent sealing, or any other desired technique, to the neck portion 28. A conventional parenteral solution set 56 has penetrated one of the ports of closure 54, which may provide a sterile seal to the container until punctured for draining of the liquid inside of the container.

As the liquid is drained, the walls of the container fold inwardly about lines of weakness 58 extending about the edges of base 22 between gussets 32, which may also be made by appropriate grooves in molds 12, 14 for thinning of lines 58. Simultaneously therewith, the walls of the container which define gussets 32 fold outwardly (see the full lines of FIG. 6), with this action being permitted by the interaction of lines 38, 34 and 36, so that the container folds simultaneously inwardly and outwardly about base 22. As the container collapses, it is possible for the collapse to proceed progressively down the length of the container, so that the amount of liquid expended can be determined with quick examination.

As the container completes its emptying, lines of weakness 60, which may also be formed by appropriate grooves in mold halves 12, 14, permit both walls of the container to collapse inwardly about the inner surface of shoulder 30 as shown, for example, in FIG. 5, to reduce the residual volume of the container. Simultaneously, gussets 43 fold outwardly, to facilitate the collapse with a reduced number of fold lines, as shown in the full lines of FIG. 6.

As the container collapses, it shortens in length, as the walls adjacent the ends collapse inwardly and outwardly.

Accordingly, a container is provided which is capable of collapsing to a residual volume of about five percent or less of the original volume with only a gentle suction pressure exerted, for example, by the suction head of a column of parenteral solution in a set extending from the container to the patient. This remarkable advantage can be obtained even though the container is made out of a relatively stiff material, for example, polypropylene or copolymers of polyethylene and polypropylene, having an overall wall thickness at the collapsible tubular wall 31 of, preferably, about 0.01 to 0.018 inch, and having a wall thickness at shoulder 30 and base 22 of preferably about 0.02 to 0.03 inch. The lines of weakness may preferably be approximately forty to seventy percent thinner than the adjacent walls, for example 0.005 to 0.007 inch at the thinnest. The thickness of the wall may be thinner adjacent the base 22 than adjacent the shoulder 30 to facilitate preferential collapse at the base area.

Referring to FIG. 7, a modified container in accordance with this invention is shown which is identical with the previous embodiment in all characteristics except as otherwise described herein.

The container 62 comprises, as before, a neck portion 63, a relatively stiff shoulder portion 64, and relatively stiff base 66, which may be slightly concave in shape, in part to accomodate the folded hanger member 68, which can fold flat into the concave recess of base 68 along thinned line of weakness 70.

A chief distinction of container 62 from the prior embodiment of container 10 is that the tubular wall 72 extending from the shoulder to the base is generally uniform in cross-sectional circumference, and not of the increasing circumference from shoulder to base, as in the previous embodiment.

Gussets 74, 76 are provided, in which the altitude of generally triangular gussets 74 may once again be different from the altitude of the generally triangular gussets 76.

The initial collapse of the container generally takes place in the region of gussets 74 and base 66, followed by the progressive collapse from the base end toward the shoulder end, and the ultimate outward folding of gussets 76 and inward folding of line of weakness 78, to provide a collapsed container of a configuration essentially similar to the previous embodiment.

It is also contemplated that, as before, the relative dimensions of base 66 and shoulder portion 64 may be varied. For example, the width of shoulder portion 64, i.e. the minor axis of its generally oval shape, may be greater than the width of base 66. The respective lengths of shoulder portion 64 and base 66 may be identical or different, as desired.

The above has been offered for illustrative purposes only and is not for the purpose of limiting the invention of this application, which is as defined in the claims below.

That which is claimed is:

1. In a flexible, collapsible container defining a relatively rigid shoulder and neck portion at one end, a relatively rigid base at the other end, and a flexible, tubular wall between said shoulder and base, the improvement comprising, in combination, said container defining, in its original, unstressed condition, first and second pairs of oppositely-disposed gussets defined in said flexible wall and positioned respectively adjacent said shoulder and said base, the first pair of gussets each defining in said wall a recessed, fold line positioned adjacent to and generally parallel with the adjacent edge of said shoulder, the second pair of gussets each defining a recessed, fold line positioned adjacent to and generally parallel with the adjacent edge of said base, each gusset portion also defining in said walls a pair of lines of folding weakness which join together in angular relationship to define an apex, said lines of weakness extending toward respective ends of their associated recessed, fold line to define a generally triangular arrangement, whereby, upon collapse of said shoulder, said gussets fold outwardly respectively from the shoulder and base.

2. The container of claim 1 in which said shoulder and base are generally oval in shape, said gussets being positioned adjacent the ends of the major axes of said shoulder and base.

3. The container of claim 2 in which the circumference of said tubular wall increases in the direction of said base.

4. The container of claim 2 in which the first gussets are different size than said second gussets.

5. The container of claim 2 in which the elevation of said first gussets in the direction of the longitudinal axis of said container is greater than said elevation of the second gussets.

6. The container of claim 2 in which the thickness of said flexible wall adjacent said first gussets is greater than the thickness of said flexible wall adjacent said second gussets.

7. The container of claim 2 in which said base is generally concave in shape; a hanger portion being attached to said base and defining foldable means whereby the hanger portion can be extended for hanging or be folded to lie flat in a recess formed by the concave base, to facilitate the ease of standing of said container on the base.

8. The container of claim 2 in which the circumference of said tubular wall is generally constant between said shoulder and neck portion and said base.

9. The container of claim 2 in which said container is free of additional, longitudinally-oriented lines of folding weakness adjacent the shoulder and base portions.

10. The container of claim 2 in which said gusset portion does not extend the entire maximum width of said container.

* * * * *